US007097051B2

(12) United States Patent
Schober et al.

(10) Patent No.: US 7,097,051 B2
(45) Date of Patent: Aug. 29, 2006

(54) HANGER ROD FOR DRYING CABINET

(75) Inventors: Stephen D. Schober, Newton, IA (US); Curtis J. Tremel, Newton, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/641,645

(22) Filed: Aug. 15, 2003

(65) Prior Publication Data

US 2005/0035076 A1 Feb. 17, 2005

(51) Int. Cl.
*A47H 1/00* (2006.01)

(52) U.S. Cl. ..... 211/123; 211/124; 211/100; 211/89.01; 34/179; 34/240

(58) Field of Classification Search ..... 211/123, 211/124, 100, 105.1, 96, 89.01, 99, 197; 248/214, 251; 16/87.4 R; 34/90, 179, 184, 34/240

See application file for complete search history.

(56) References Cited

U.S. PATENT DOCUMENTS

| | | | | | |
|---|---|---|---|---|---|
| 1,922,989 | A | * | 8/1933 | Terry | 211/88.04 |
| 2,422,922 | A | * | 6/1947 | Nudelman et al. | 211/124 |
| 2,573,275 | A | * | 10/1951 | Richey | 224/313 |
| 2,746,660 | A | * | 5/1956 | Golden | 224/313 |
| 2,895,618 | A | * | 7/1959 | Nathan | 211/123 |
| 2,904,190 | A | * | 9/1959 | Gidwitz et al. | 211/123 |
| 3,540,601 | A | * | 11/1970 | Hutchison | 211/32 |
| 3,594,914 | A | * | 7/1971 | Kutsuki et al. | 34/380 |
| 3,696,523 | A | * | 10/1972 | Beeley et al. | 34/216 |
| 3,739,496 | A | | 6/1973 | Buckley et al. | |
| 3,770,148 | A | | 11/1973 | Hendren | |
| 3,991,884 | A | * | 11/1976 | DeMaagd et al. | 211/1.51 |
| 4,548,328 | A | * | 10/1985 | Brauning | 211/205 |
| 4,577,766 | A | * | 3/1986 | Miller | 211/123 |
| 4,760,929 | A | * | 8/1988 | Fedorchak | 211/123 |
| 4,858,870 | A | * | 8/1989 | Mazzanti | 248/316.1 |
| 4,971,210 | A | * | 11/1990 | Blumenkranz et al. | 211/123 |
| 5,129,524 | A | * | 7/1992 | Holman | 211/113 |
| 5,226,569 | A | * | 7/1993 | Watjer et al. | 224/313 |
| 5,647,492 | A | * | 7/1997 | Fillios et al. | 211/123 |
| 5,836,486 | A | | 11/1998 | Ohsugi | |
| 5,887,710 | A | * | 3/1999 | London et al. | 206/289 |
| 6,029,828 | A | * | 2/2000 | Robbins et al. | 211/78 |
| 6,164,466 | A | * | 12/2000 | Baradat | 211/186 |
| 6,334,558 | B1 | * | 1/2002 | Sher | 223/1 |
| 6,488,159 | B1 | * | 12/2002 | Shuen | 211/123 |

FOREIGN PATENT DOCUMENTS

| | | | |
|---|---|---|---|
| JP | 409010485 | A | 1/1997 |
| JP | 411276797 | A | 10/1999 |
| JP | 02000116992 | A | 4/2000 |
| JP | 02001276491 | A | 10/2001 |
| JP | 02002000997 | A | 1/2002 |

* cited by examiner

*Primary Examiner*—Jennifer E. Novosad
(74) *Attorney, Agent, or Firm*—McKee, Voorhees & Sease, P.L.C.

(57) ABSTRACT

A hanger rod for a clothes drying cabinet includes a plurality of notches, each adapted to receive a hanger. Each notch is V-shaped, with opposite side walls which converge downwardly to a substantially pointed apex. The rod has front and rear walls defining a thickness ranging between 30%–75% of the hanger hook diameter. The notches provide four contact points on the hanger hook to prevent rotation of the hanger hook on the rod during the drying process.

19 Claims, 3 Drawing Sheets

HANGER ROD FOR DRYING CABINET

BACKGROUND OF THE INVENTION

Hanger rods are well known for use in closets for receiving hangers with clothes. Hanger rods have also been provided in clothes drying cabinets to hang clothes during the drying process. Some prior art rods are provided with notches to maintain spacing between the hangers. In a drying cabinet, it is desirable to shake hanging clothes during the drying process to facilitate de-wrinkling of the clothes. However, with prior art hanger rods, the hangers tend to twist, which allows the clothes to contact one another. Such contact between the clothes decreases drying efficiencies and creates possibilities of dye transfer between the wet clothes.

Therefore, a primary objective of the present invention is the provision of an improved hanger rod for a clothes drying cabinet.

Another objective of the present invention is the provision of a hanger rod which prevents twisting or swiveling of the hangers when the rod is shaken.

A further objective of the present invention is the provision of a hanger rod for a clothes drying cabinet which maintains spacing between the hanging clothes during the drying process.

Another objective of the present invention is the provision of a hanger rod for supporting hangers thereon, with the rod having a plurality of notches, with each notch having four points of contact with the hanger hook to prevent rotation of the hanger on the rod.

A further objective of the present invention is the provision of a hanger rod for supporting hangers, with the rod having a plurality of V-shaped notches tapering to a pointed apex, and the rod having a thickness from 30%–75% of the hanger hook diameter.

These and other objectives will become apparent from the following description of the invention.

SUMMARY OF THE INVENTION

The hanger rod of the present invention is adapted for use in a drying cabinet to support hangers with clothes or garments during the drying process. The hanger rod includes an elongated bar having a plurality of notches, each adapted to receive a hanger. Each notch is V-shaped and tapered downwardly to a substantially pointed apex. The bar thickness ranges between 30%–75% of the hanger hook diameter. Each notch provides four points of contact with the hanger hook to prevent rotation of the hanger on the bar, particularly as the bar is shaken during the drying process. By preventing rotation or twisting of the hangers on the rod during the drying process, drying efficiencies are improved and risk of color transfer between wet garments is eliminated.

DETAILED DESCRIPTION OF THE PREFERRED EMBODIMENT

Figure 1:
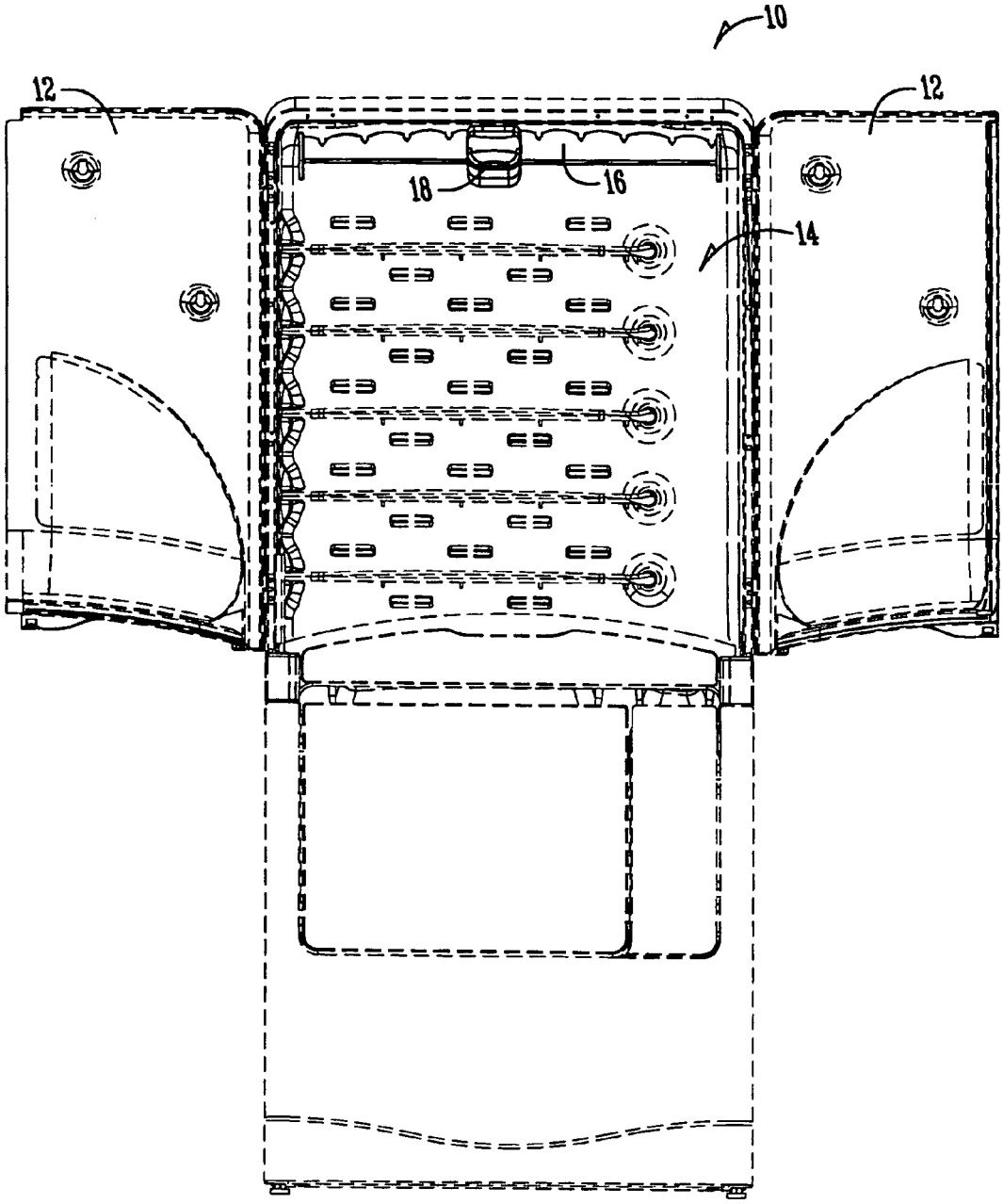
FIG. 1 is a perspective view of a clothes drying cabinet with the upper doors open to show the hanger rod of the present invention.
Figure 2:
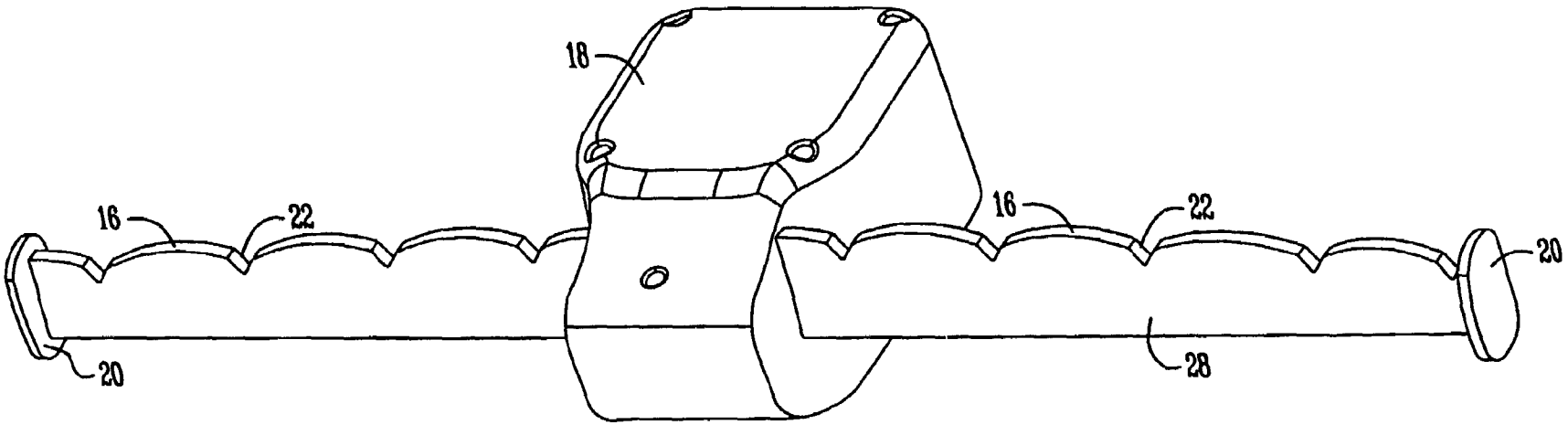
FIG. 2 is a perspective view of the hanger rod of the present invention.
Figure 3:
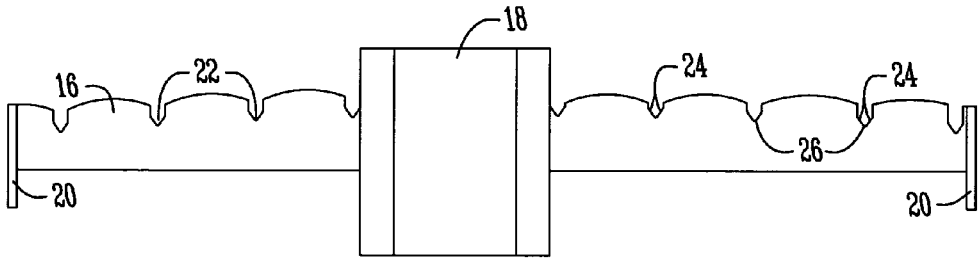
FIG. 3 is a front elevation view of the hanger rod of the present invention.
Figure 4:
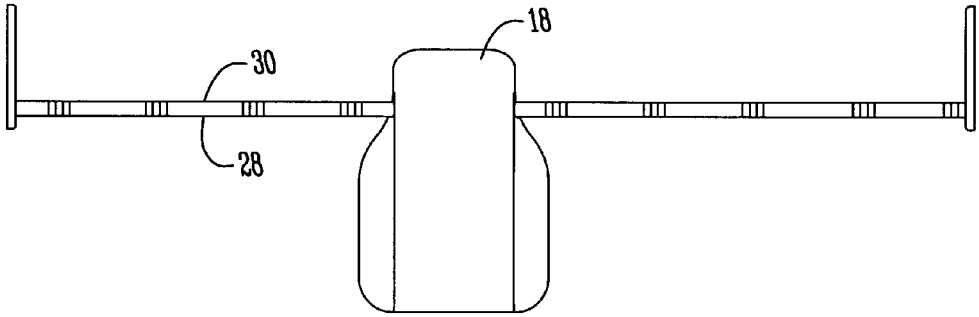
FIG. 4 is a top plan view of the hanger rod of the present invention.
Figure 5:
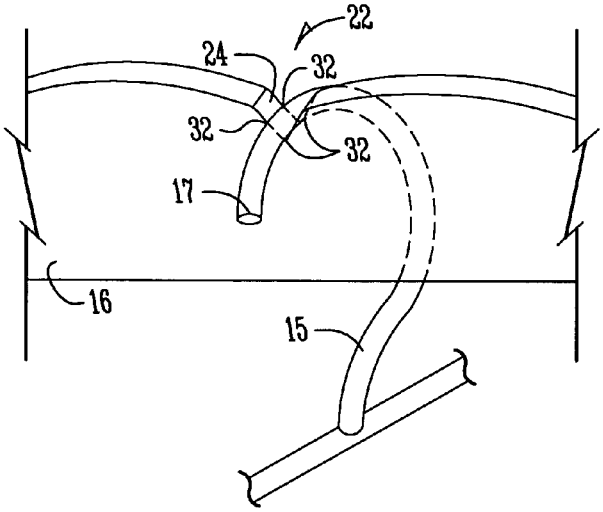
FIG. 5 is an enlarged partial sectional view of one of the hanger rod notches with a hanger received therein.
Figure 6:
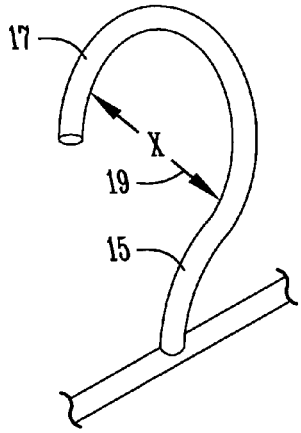
FIG. 6 is a partial front elevation view of a hanger hook.

A clothes drying cabinet is designated by the reference numeral 10 in the drawings. The cabinet 10 includes a pair of upper doors 12 which are movable between open and closed positions to provide access to an internal drying chamber 14. The drying chamber 14 includes a hanger rod 16 mounted therein to support hangers 15 with clothes or garments for drying in the chamber 14. A shaker 18 may be operatively mounted within the internal drying chamber 14 and attached to the hanger rod 16 so as to shake the rod 16 during the drying process to facilitate de-wrinkling of the clothes or garments.

The present invention is directed towards the hanger rod 16. The rod 16 generally is an elongated bar with opposite ends 20 which are mounted in the drying chamber 14 in any convenient manner. The hanger rod or bar 16 includes a plurality of notches 22 spaced along the length of the rod 16. The notches 22 are each adapted to receive the hanger 15. The hangers 15 may be any commercially available hanger purchased at stores. For example, the hanger rod 16 notches 22 will accommodate conventional wire hangers having a 0.07 inch diameter, or plastic hangers having a 0.44 inch diameter. Each hanger 15 includes an upper hook 17 with a diameter 19 ranging between 1–2.5 inches.

Each notch 22 is generally V-shaped, having opposite side walls 24 which converge downwardly to a substantially pointed apex 26. Of course, the notches could be parabolic or any of a number of converging shapes. Preferably, the lateral side walls 24 of the notches 22 are oriented at approximately a 70° angle. In a preferred embodiment, the apex 26 has a radius of approximately 0.03 inch, which will accommodate both wire and plastic hangers. The notches 22 in the hanger rod 16 are preferably spaced approximately 2.9 inches center to center.

The hanger rod 16 has a thickness preferably ranging between 30%–75% of the hook diameter. A minimum rod thickness is 0.30 inch for a hook diameter of 1 inch. A rod thickness of 0.75 inch will accommodate hanger hooks 17 with diameters 1–2.5 inches. The notches 22 of the hanger rod 16 define four points of contact with the hanger hook 17 each to prevent rotation of the hanger 15 on the rod 16. More particularly, the lateral side walls 24 of the notches 22 each define opposite contact points 32 adjacent each of the front and back walls 28, 30. Thus, the hanger hook 17 has a pair of opposite lateral contact points 32 on each lateral side wall 24.

During use of the drying cabinet 10, hangers 15 having clothes or garments thereon are placed in the notches 22 of the hanger rod 16. The four spaced apart contact points 32 between the hanger rod 16 and the hanger hook 17 prevent rotation of the hanger 15 on the rod 16, even when the rod 16 is shaken by the shaker 18 to de-wrinkle the clothes. By precluding rotation or twisting of the hangers 15 on the rod 16, drying and de-wrinkling of the clothes is enhanced while the risk of color transfer through contact between wet clothes is minimized or eliminated.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved cabinet dryer, comprising:

an elongated hanger bar for supporting hangers in the dryer, the hangers each having an upper hook defining a hook diameter;

a shaker connected to the hanger bar to shake the hanger bar to facilitate wrinkle removal in clothes on the hangers;

the hanger bar having a plurality of notches each adapted to receive and provide vertical support for a hanger; and each notch having four points of contact for the hanger hook to prevent rotation of the hanger on the hanger bar when the hanger bar is shaken.

2. The dryer of claim 1 wherein the contact points include opposite pairs of lateral contact points.

3. The dryer of claim 2 wherein the pairs of lateral contact points are defined by opposite lateral side walls of each notch and by the front and rear walls of the bar.

4. The dryer of claim 3 wherein each pair of lateral contact points associated with a lateral side wall are spaced apart approximately 0.75 inches.

5. The dryer of claim 1 wherein each notch has opposite lateral side walls oriented at approximately a 70° angle.

6. The dryer of claim 1 wherein the notches are spaced apart approximately 2.9 inches center-to-center.

7. The dryer of claim 1 wherein the bar has a thickness of approximately 0.75 inches.

8. The dryer of claim 1 wherein the apex has a radius of approximately 0.03 inches.

9. The dryer of claim 1 wherein the bar has a minimum thickness of 0.30 inch.

10. The dryer of claim 1 wherein the bar is flat.

11. The dryer of claim 1 wherein the hanger bar has opposite ends and the shaker is disposed between the ends of the bar.

12. The dryer of claim 1 wherein the dryer has opposite lateral sides and the hanger bar extends laterally.

13. The dryer of claim 1 wherein the shaker engages the hanger bar.

14. The dryer of claim 1 wherein the shaker is disposed approximately midway between opposite ends of the hanger bar.

15. The dryer of claim 1 wherein the hanger bar extends through the shaker.

16. The dryer of claim 1 wherein the shaker encircles the hanger bar.

17. The dryer of claim 1 wherein the shaker is centrally located within the dryer.

18. The dryer of claim 17 wherein the shaker engages the hanger bar approximately midway between opposite ends of the hanger bar.

19. The dryer of claim 1 wherein the shaker is supported upon the hanger bar.

* * * * *